US009241849B1

(12) United States Patent
Caskey

(10) Patent No.: US 9,241,849 B1
(45) Date of Patent: Jan. 26, 2016

(54) APPARATUS FOR RESCUE AND RECOVERY OF INCAPACITATED PERSONS

(76) Inventor: Wesley Wyatt Caskey, Richardson, TX (US)

( * ) Notice: Subject to any disclaimer, the term of this patent is extended or adjusted under 35 U.S.C. 154(b) by 802 days.

(21) Appl. No.: 12/082,826

(22) Filed: Apr. 15, 2008

Related U.S. Application Data

(60) Provisional application No. 60/923,694, filed on Apr. 16, 2007, provisional application No. 61/011,655, filed on Jan. 18, 2008.

(51) Int. Cl.

| | |
|---|---|
| ***A61G 5/00*** | (2006.01) |
| ***A61G 7/053*** | (2006.01) |
| ***A61G 1/02*** | (2006.01) |
| *A61G 1/00* | (2006.01) |

(52) U.S. Cl.
CPC ..... *A61G 1/02* (2013.01); *A61G 1/0212* (2013.01); *A61G 1/0268* (2013.01); *A61G 1/00* (2013.01)

(58) Field of Classification Search
CPC ..... A61G 1/00; A61G 1/003; A61G 1/02; A61G 1/0212; A61G 1/0237; A61G 1/0268
USPC ..... 5/86.1, 626, 627, 625, 620; 280/646, 280/39; 296/20
See application file for complete search history.

(56) References Cited

U.S. PATENT DOCUMENTS

| | | | | |
|---|---|---|---|---|
| 2,982,392 | A * | 5/1961 | Bossone | 224/400 |
| 4,579,381 | A * | 4/1986 | Williams | 296/20 |
| 6,607,207 | B2 | 8/2003 | Shapiro et al. | |
| 6,824,150 | B2 | 11/2004 | Simione | |
| 7,044,496 | B2 | 5/2006 | Holmes | |
| 2007/0113344 | A1* | 5/2007 | Hurwitz | 5/620 |
| 2008/0155751 | A1* | 7/2008 | Thompson et al. | 5/626 |

* cited by examiner

*Primary Examiner* — David E Sosnowski
(74) *Attorney, Agent, or Firm* — Jeffrey Roddy

(57) ABSTRACT

A rescue apparatus and method for the transport of injured persons from an area deemed immediately dangerous to life and health (IDLH), being a low-profile wheeled platform with a shaped aperture having the contour matching that of an air-pack. Immobilized fire fighters or others may be placed in a supine position atop the platform, their air packs entering into the contoured aperture; so that they may utilize the air supply while being evacuated. The wheels of the apparatus preferably straddle a fire hose during the transport using it as a guide for safe egress from the IDLH environment.

10 Claims, 7 Drawing Sheets

APPARATUS FOR RESCUE AND RECOVERY OF INCAPACITATED PERSONS

CROSS REFERENCE TO RELATED APPLICATIONS

This application claims the benefit of U.S. Provisional Application 60/923,694 filed Apr. 16, 2007 titled: Wheeled Apparatus for Rescue and Recovery of Incapacitated Individuals and U.S. Provisional Application 61/011,655 filed Jan. 18, 2008 titled: Apparatus for the rescue and recovery of incapacitated persons

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention relates broadly to an apparatus for the rescue and recovery of incapacitated personnel and especially downed fire fighting personnel in structures that are deemed immediately dangerous to life or health (IDLH). Structures designated IDLH pose a danger to second responders such as so-called Rapid Intervention Crews, or Rapid Intervention Teams, hereafter referred to as (RIC/RIT), as they are normally fatigued prior to reaching the incapacitated person. Speed in removal of the incapacitated person is critical as blazes may quickly reach flash point. Keeping the incapacitated person and the RIC/RIT below the so-called thermal layer is also critical as the temperature may vary by more than 1000 F from the floor to a height of only three feet. Lack of visibility is a critical factor in most blazes and it is essential that the RIC/RIT keep all equipment on their person to avoid misplacing it. Additionally, it is well understood that the fire hose is the lifeline for the rescue personnel and following it is critical to exiting the structure. Many states have adopted OSHA's new Respiratory Protection Standard; the so-called "two-in/two-out" policy according to the Department of Labor. Many other states such as Texas, which do not fall under OSHA, have codified the policy in state law. The policy requires that two firefighters enter structures with atmospheres that are deemed IDLH. One common carry used to remove injured personnel is the two fire-fighter carry where one rescuer holds the incapacitated persons legs and the other supports the torso while lifting the injured person to safety; a disadvantage of this type of carry is that it places the firefighters above the thermal layer. Another carry is the so-called firefighter drag where the rescuers drag the person to safety while keeping the firefighters below the thermal layer; but is much more physically demanding than the two firefighter carry because rescuers carry in excess of 50 additional pounds in the form of protective gear.

What is needed is a means for extricating injured personnel while allowing the rescue crew to stay below the thermal layer and minimizing the amount of straining required to move an injured person.

SUMMARY OF THE INVENTION

The present invention is meant to assist these second responders in the rescue of incapacitated personnel in the IDLH atmosphere. Nowhere in the art is found an apparatus suited for the demands of this type of rescue and recovery. The apparatus is lightweight being fashioned from either heat resistant plastics, resins or aluminum alloy, and is low to the ground so as to keep the incapacitated person and the RIC/RIT below the thermal layer. The apparatus may be fitted to the back of a RIC/RIT member, over the air pack and worn or carried into a structure. Once the incapacitated person is located, the apparatus may be removed from the team member's air pack and fitted to the incapacitated person's air pack where they are then lowered into a supine position atop the apparatus allowing them to continue using their air supply while being transported. Fitting the apparatus is easily accomplished whether the injured are brought to a sitting position or on their stomach or side with the sitting position being most preferred. Exiting the structure is accomplished by following the water line over which the apparatus is rolled.

Although primarily designed with fire personnel in mind, conceivably, this apparatus may also be used for the rescue of miners and others in confined locations. A cable may be attached to the apparatus and the incapacitated person winched out of a confined location such as with a low ceiling. It is also conceivable that the present invention may be paired with electrical drives and servos and be piloted by remote radio control and GPS.

The apparatus is a wheeled platform having a contoured opening in the body of the apparatus designed to cradle or accept an air tank and allowing its passage with the associated air gauges and air hoses. This allows the incapacitated person to retain the use of the air pack as they are being rolled out of the structure using the pressurized water hose as a guide. It takes much less effort to wheel an incapacitated person than to carry them. All members of the RIC/RIT are kept below the thermal layer owing to the low profile of the present invention. Because the apparatus is fitted to the incapacitated person, rather than having to lift the incapacitated person onto the apparatus, the risk of back injury for the RIC/RIT is reduced.

In the preferred embodiment of the present invention, a opening longitudinally positioned in a rectangular platform provides a contoured mouth for the admittance of an air pack. The opening tapers to an exit on the underside of the platform. The tapering provides for a snug fit about the air pack that eliminates lateral and longitudinal movement of the injured person. The contour of the opening depends on the particular air tank employed. The platform is fitted with wheeled assemblies that straddle a water hose and allow the platform to follow the water line out of the IDLH environment. Preferably the wheeled assemblies would allow the wheels to collapse for storage, although conceivably they may be fixed in an extended position.

In an alternate embodiment the longitudinally positioned opening is rectangular in shape and opens to a recess formed into the body of the apparatus to the bottom of which have been affixed laterally bowed spring clamps to grip the air tank.

Various lightweight materials for constructing the platform are suitable such as molded resin, fiber-glass, carbon fiber or aluminum.

One object of the present invention is to provide a means for the safe transport of an incapacitated personnel out of a structure designated IDLH.

Another object of the present invention is to provide a means for transport of an incapacitated personnel out of a structure designated IDLH, while keeping both the rescue personnel and the transported person below the thermal layer.

Another object of the present invention is to allow the transported person to continue to use their air pack while being moved to safety.

Still another object of the present invention is to provide a lightweight unit having a low profile design that may be either carried by or worn by rescuers into a structure designated IDLH.

Yet another object of the present invention is reduce the risk of back injury for rescue personnel by permitting the fitting of the present invention to the back of an incapacitated person thus obviating the need for lifting.

The description as follows is not intended to limit the scope of the invention to the particular forms set forth, but on the contrary, it is intended to cover such alternatives, modifications, and equivalents as may be included within the spirit and scope of the invention as defined by the appended claims.

DETAILED DESCRIPTION OF THE EMBODIMENTS

Terminology

IDLH designates an environment that is immediately dangerous to life or health.

Thermal layer refers to the tendency of gasses to form in layers according to temperatures of up to 1200 F and under which fire fighting personnel attempt to operate.

Platform refers to a body of light weight and heat resistant material that may be formed by thermoforming methods, vacuum forming or molding or stamping.

Rigid light weight heat-resistant material refers generally to those materials comprised of resin and fiber such as fiber glass as well as carbon fiber. Not excluded in this definition would be those thermoplastics used in vacuum forming such as KYDEX® GND thermoplastic alloy sheet or aluminum alloys.

Laterally bowed spring clamps refer to a class of generally U-shaped clamps where a cylindrical object is secured by pressing the object between the arms of the spring clamp whereby the arms are forced apart to allow the object to seat and thus inhibiting lateral movement of the seated cylindrical object.

Air pack refers to any of the SCBA (self contained breathing apparatus) or CCBA (closed circuit breathing apparatus) used by rescue works and fire fighters and manufactured by Scott Health and Safety, MSA and others.

Figure 1:
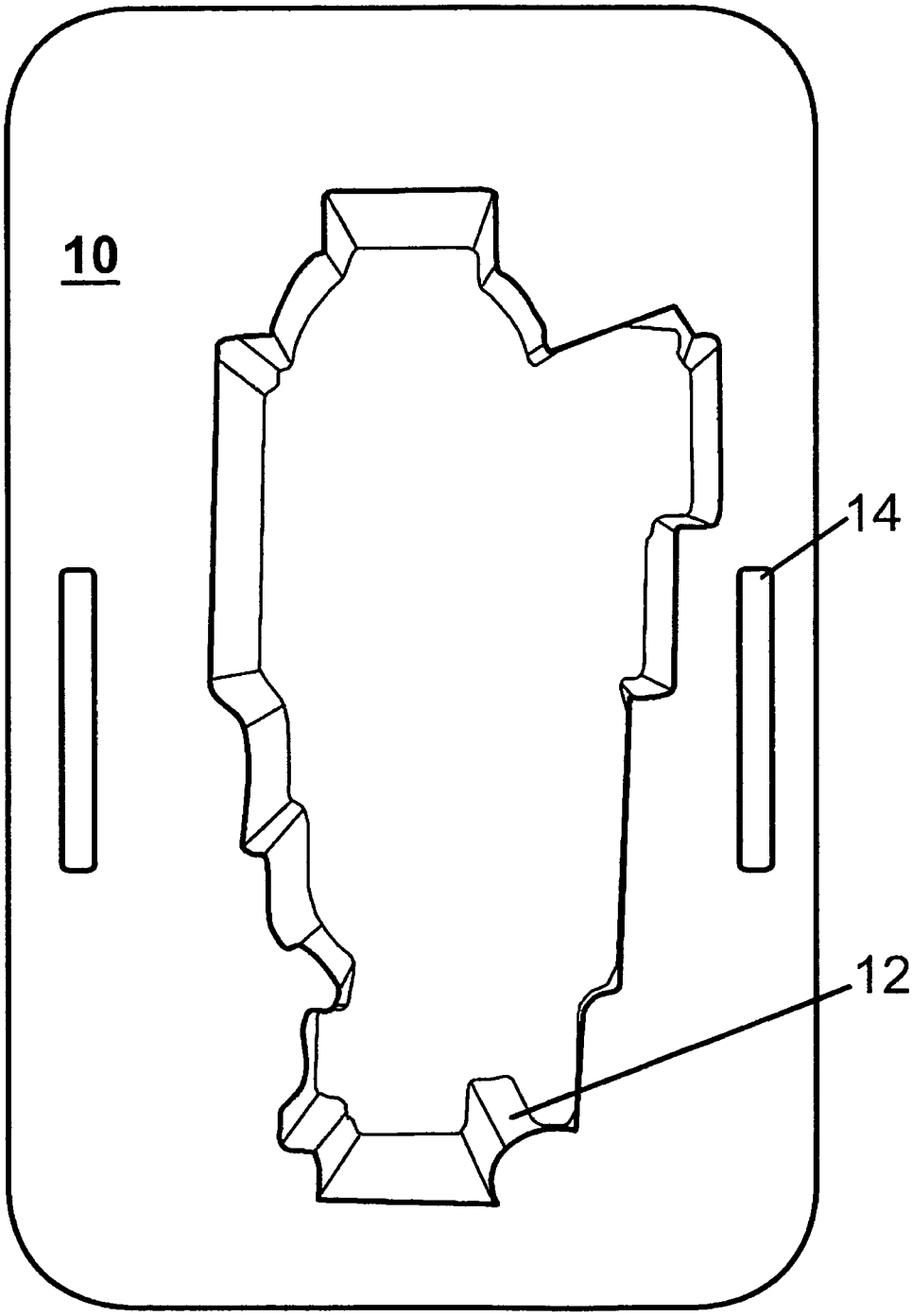
FIG. 1 shows a plan view of the platform with contoured recess for the acceptance of an air tank.
Figure 3:
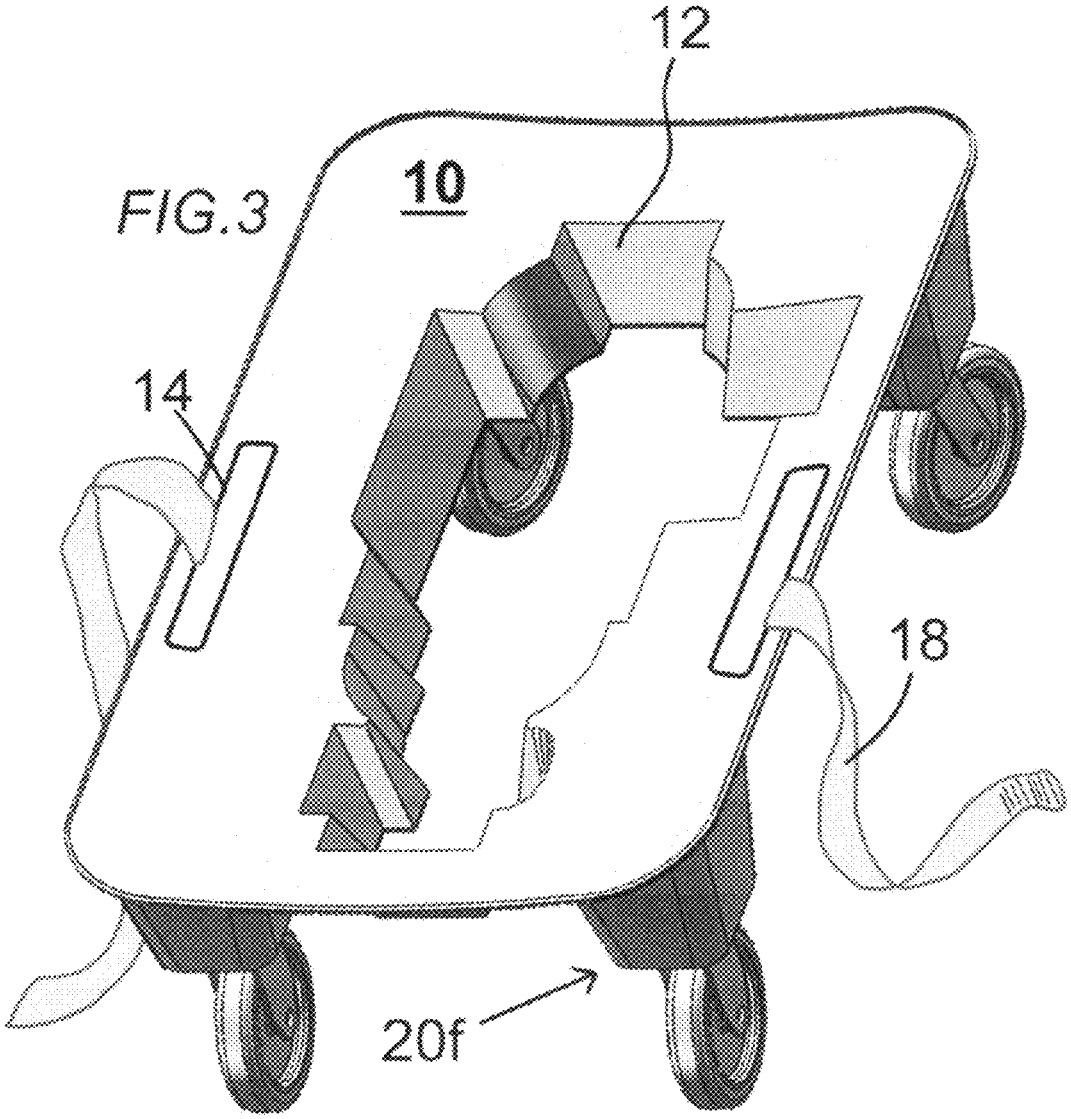
FIG. 3 shows a perspective view of one embodiment with fixed wheels.

FIG. 1 shows a top view of the preferred embodiment of the apparatus with platform 10, contoured tapered opening 12 and side slits 14 for hand holds or attachment of safety belt 18 (FIG. 3). The platform is preferably constructed of a rigid light weight heat-resistant material such as vacuum formed thermoplastic, carbon fiber or aluminum alloy, though a wide range of materials such as wood laminate may be used. The methods of manufacture conceived for the platform are common and well understood in the art and may consist of additive processes such a layered fiber glass and resin compositions, pour molding and injection molding.

Fire and rescue departments tend to be standardized as to types of air packs employed, there being some variety on the market such as MSA, Scott air packs and others. The forms of the various air packs vary with the manufacturer, so a fire rescue team would select the appropriate contoured opening to match their equipment. The tapered opening 12 of FIG. 1 was designed for a Scott air pack. However, some of the newer CCBA air packs are substantially rectangular and it follows that the opening could take that shape or any other as required. Tapered contours for a particular make and model of air pack are obtained at design time by taking measurements of the air pack with associated hoses and connectors while being worn, and allowances made for movement of the various elements so that the air pack is funneled into a stable position when the platform opening is placed over it.

Figure 2:
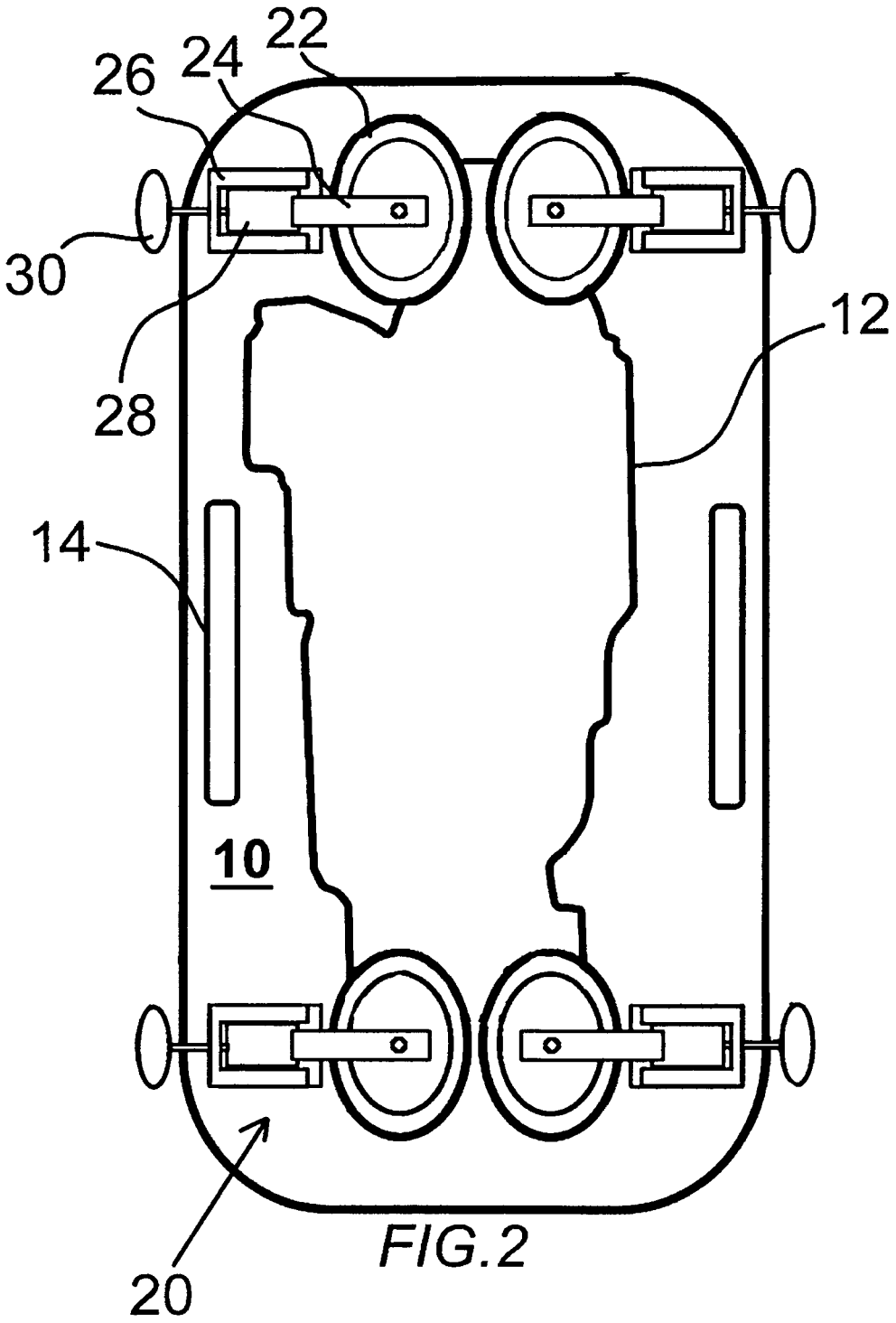
FIG. 2 shows a plan view of the bottom of the platform with wheels in collapsed position.
Figure 9:
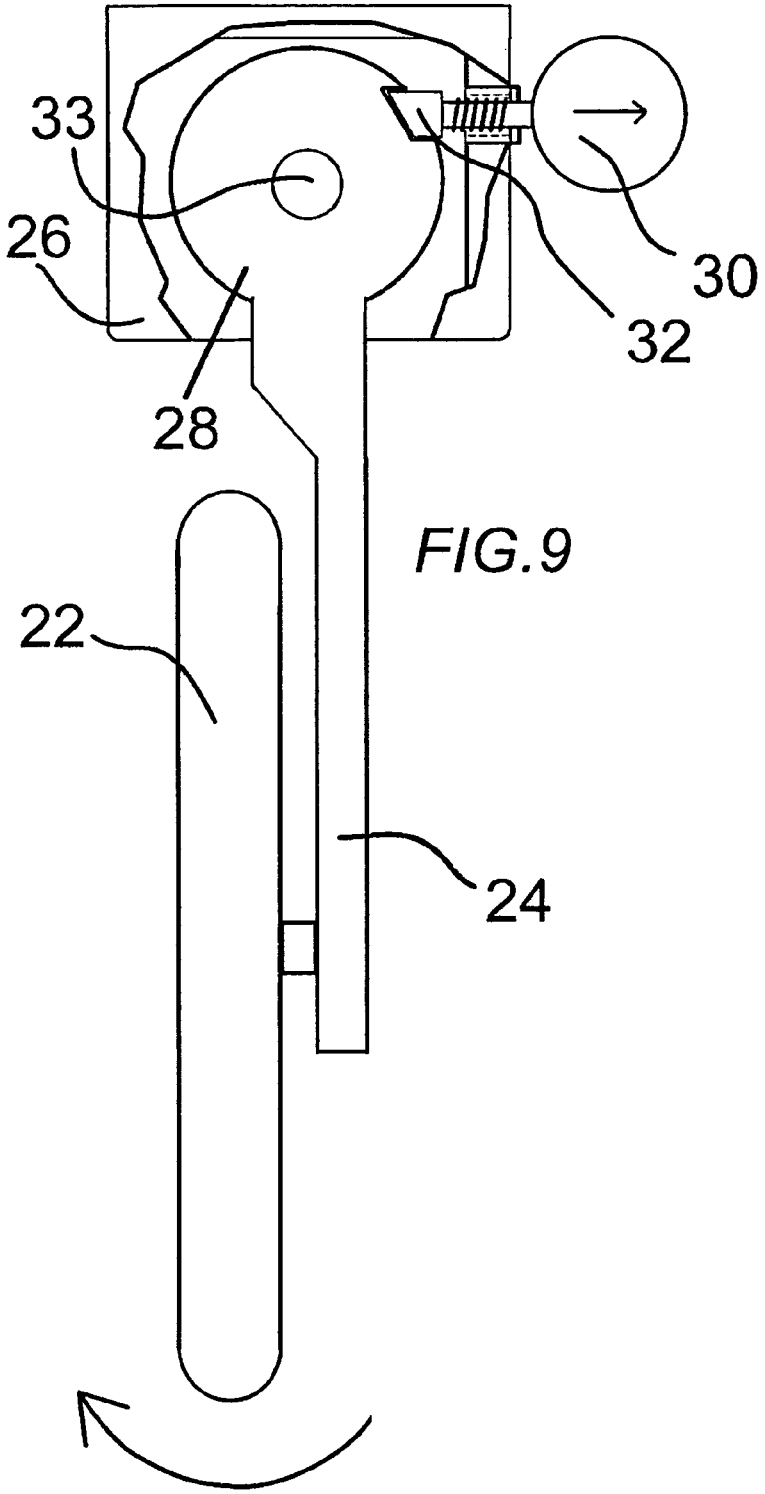
FIG. 9 shows a detail view of collapsible wheel assembly with bracket partially cutaway.

FIG. 2 shows the underside of the platform with wheels in collapsed position, important for storage on rescue vehicles with little available space. While collapsible wheel assemblies 20 are preferred, fixed wheel assemblies **20*f* such as shown in FIG. 3 will operate effectively and may offer some cost advantages in manufacture. One non-limiting example of a possible collapsible wheeled assembly is shown in FIG. 9; a cutaway view shows a single fork 24 and pivot cam 28 affixed by shaft 33 within a U bracket 26 where the pivoting cam 28 is releasably lockable in an extended position, wheels outward, by means of a spring tensioned stay 32 slid into a recess in the pivot cam preventing movement, and collapsed by pulling knob 30 removing the stay from the recess and folding the fork and wheel 24, 22** inward toward the platform. Another possibility is that of wheels with independent suspension such as are used in some off road vehicles or all terrain vehicles (ATV).

Figure 4:
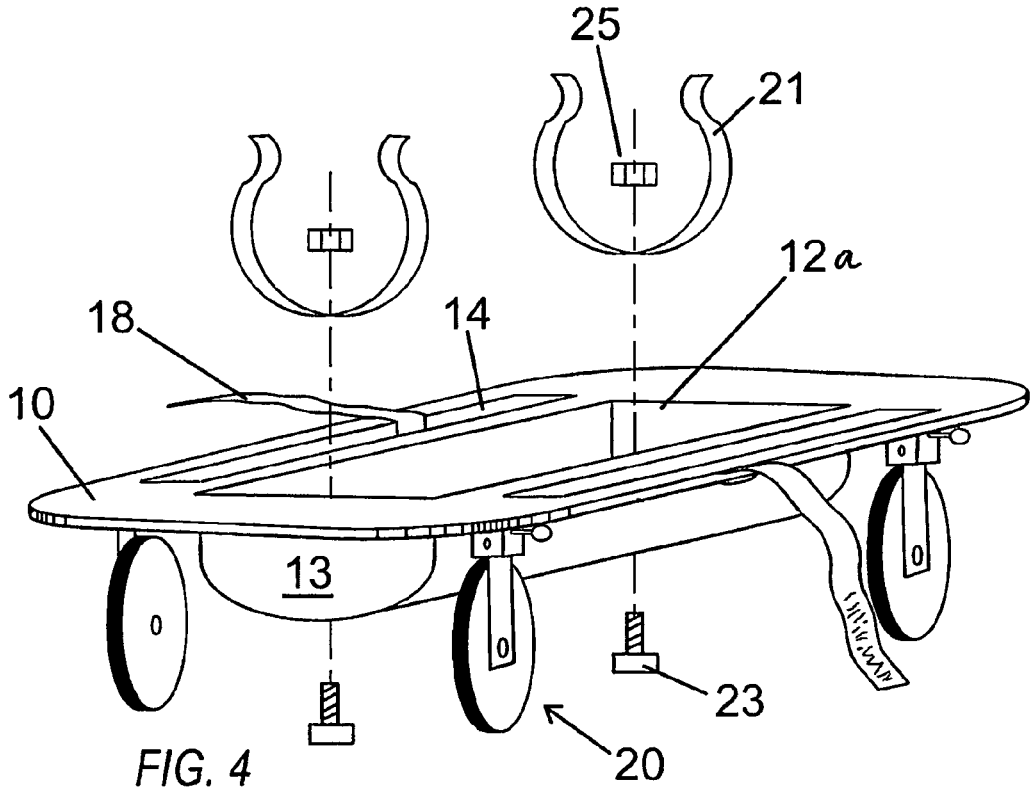
FIG. 4 shows a perspective view of an embodiment with an enclosed recess with brackets.
Figure 5:
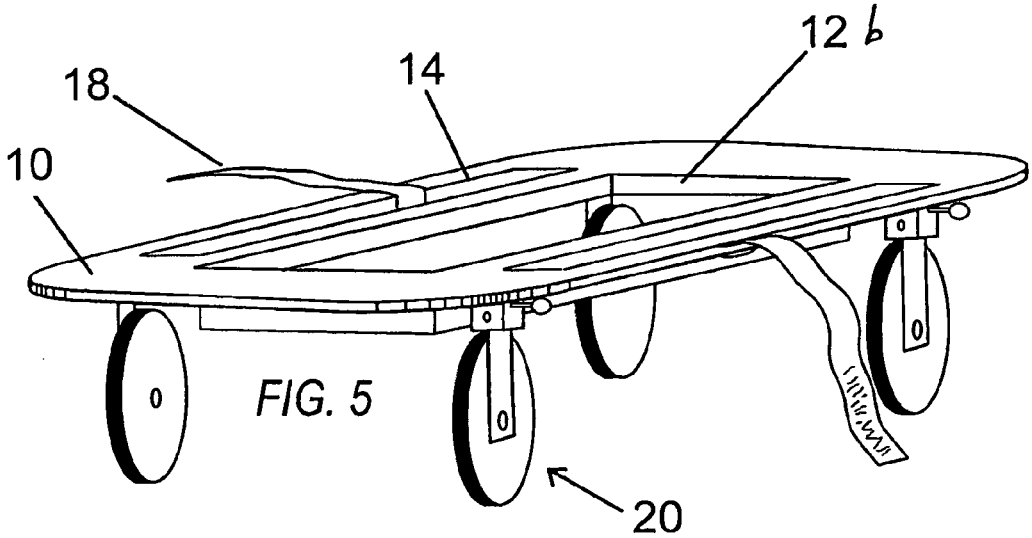
FIG. 5 shows a perspective view of another embodiment with a rectangular recess.
Figure 6:
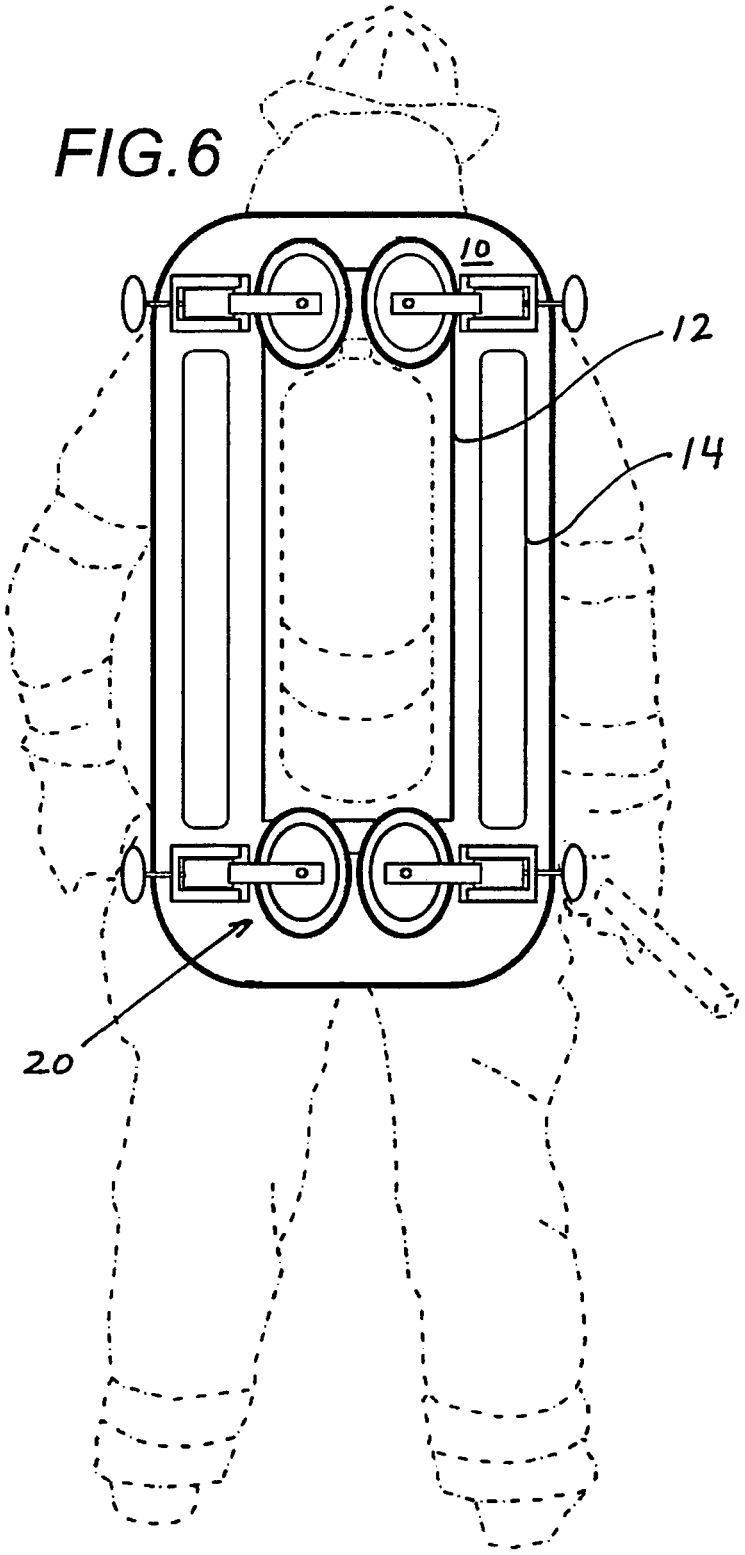
FIG. 6 illustrates a rescue team positioning the present invention upon the air pack of a downed fire fighter.

FIG. 4 shows an alternate embodiment of the apparatus with a rectangular opening and enclosed recess that may be used with some of the older air packs with larger air tank. The non-tapered recess **12*a* in the body of the platform 10 receives the air tank and laterally bowed spring clamps 21 affixed to the bottom of the recess secure the air tank. The means to affix the spring clamps is shown here as a nut and bolt 25, 23 however, they could be molded into the recess, or the recess molded to assume an arcuate shape similar to the spring clamps to receive an air tank without affecting the function. FIG. 5 shows a rectangular opening 12*b*** with an exit that would be suitable for some recent CCBA's that are modular being squarish or rectangular in shape.

Figure 7:
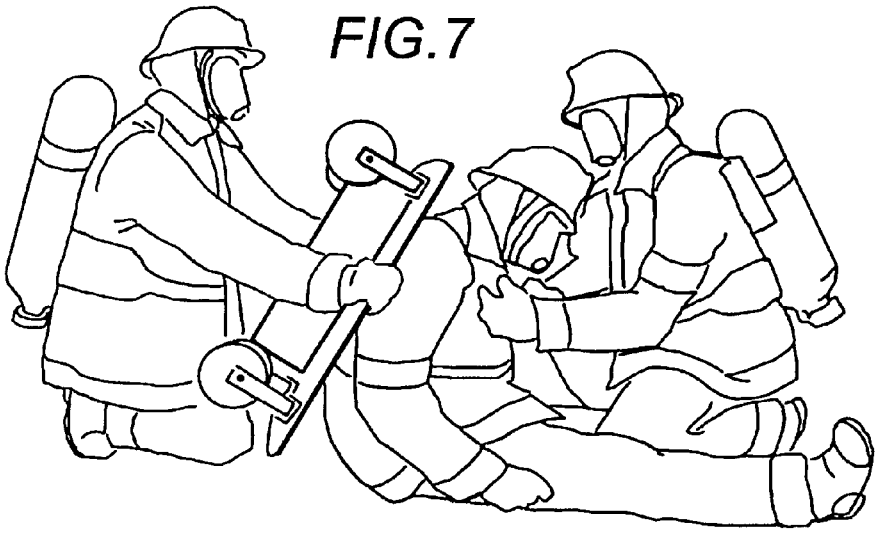
FIG. 7 illustrates the downed fire fighter placed in supine position atop the present invention.
Figure 8:
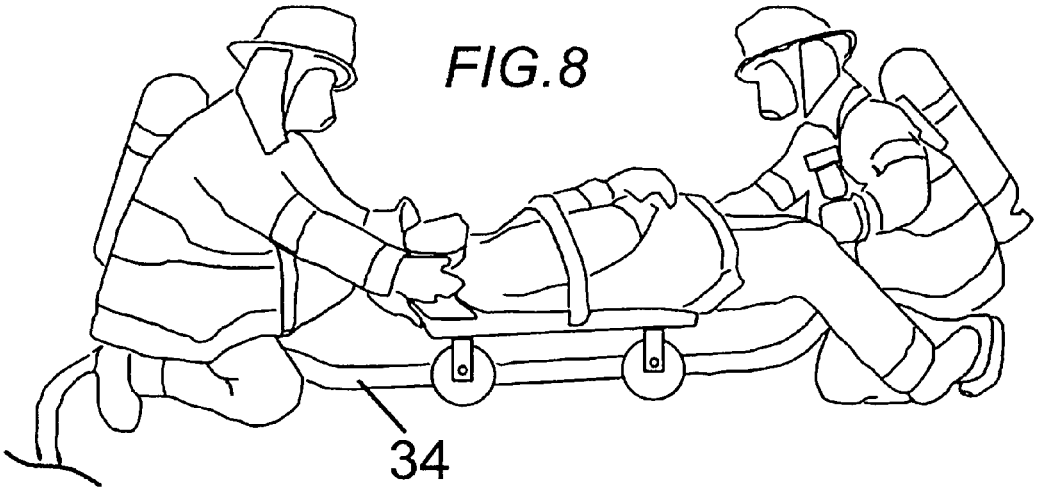

FIGS. 7-8 show the apparatus being fitted respectively to the back of a downed fire fighter encompassing the air pack; and the downed fire fighter lowered into a supine position atop the apparatus' platform. The water line 34 is shown preferentially running under and between the apparatus wheels so that the rescue personnel may use it as a guide to exiting the IDLH environment.

The invention claimed is:

1. A wheeled apparatus for use in the rescue and recovery of incapacitated persons comprising:

a substantially rectangular platform with a top surface supportive of a person having a longitudinally positioned opening encircled by the top surface and contoured to restrict admittance to an air pack and permit passage therethrough;

a plurality of wheel assemblies allowing for the rolling support of said platform;

a fastening means to securely retain said incapacitated person in a supine position atop said platform; and in which said opening tapers to an exit in the direction of the ground when the wheels of the platform are in contact with the ground.

2. The wheeled apparatus of claim 1 in which said plurality of wheels each have a releasably lockable extended position and a collapsible position being folded against said platform.

3. The wheeled apparatus of claim 1 in which said plurality of wheels each have independent suspension.

4. The wheeled apparatus of claim 1 in which height from the distal end of each of the wheels in extended position to said platform no greater than 20 inches.

5. The wheeled apparatus of claim 1 in which said fastening means are opposing straps with connectable distal ends.

6. The wheeled apparatus of claim 1 in which said fastening means is a belt and cinch.

7. The wheeled apparatus of claim 1 in which said opening is terminated by a recessed enclosure.

8. The wheeled apparatus of claim 1 in which said opening is terminated by a recessed enclosure, the bottom of which having been fitted with spring clamps for the releasable retention of an air tank.

9. The wheeled apparatus of claim 1 in which said opening is terminated by a recessed enclosure shaped to receive a particular make and model of air pack.

10. A wheeled apparatus for use in the rescue and recovery of incapacitated persons comprising:

a substantially rectangular platform with a top surface supportive of a person having a longitudinally positioned opening encircled by the to surface and contoured to restrict admittance to an air pack and permit passage therethrough;

a plurality of wheel assemblies allowing for the rolling support of said platform;

a fastening means to securely retain said incapacitated person in a supine position atop said platform; and in which said rectangular platform is curved at the periphery to cup a human torso.

* * * * *